US006509535B2

(12) United States Patent
Nakamura

(10) Patent No.: US 6,509,535 B2
(45) Date of Patent: Jan. 21, 2003

(54) MULTI DIRECTIONAL INPUT APPARATUS

(75) Inventor: Masahiko Nakamura, Osaka (JP)

(73) Assignee: Hosiden Corporation, Osaka (JP)

( * ) Notice: Subject to any disclaimer, the term of this patent is extended or adjusted under 35 U.S.C. 154(b) by 0 days.

(21) Appl. No.: 09/779,698

(22) Filed: Feb. 9, 2001

(65) Prior Publication Data

US 2001/0020574 A1 Sep. 13, 2001

(30) Foreign Application Priority Data

Feb. 10, 2000 (JP) ..... 2000-34015

(51) Int. Cl.[7] ..... H01H 19/00
(52) U.S. Cl. ..... 200/6 A; 200/335
(58) Field of Search ..... 200/6 A, 553, 200/332, 335; 338/128, 131, 133

(56) References Cited

U.S. PATENT DOCUMENTS 4,459,578 A * 7/1984 Save et al. ..... 338/128
4,489,304 A * 12/1984 Hayes ..... 338/128
5,107,080 A * 4/1992 Rosen ..... 200/6 A
5,113,714 A * 5/1992 Eklund et al. ..... 74/471 XY
5,286,024 A * 2/1994 Winblad ..... 273/148 B
5,491,462 A * 2/1996 Cecchi et al. ..... 338/128
5,589,854 A * 12/1996 Tsai ..... 345/161
5,773,773 A * 6/1998 McCauley et al. ..... 200/6 A
6,064,369 A * 5/2000 Okabe et al. ..... 345/161
6,150,919 A * 11/2000 Shimomura ..... 338/128
6,201,196 B1 * 3/2001 Wergen ..... 200/6 A
6,275,139 B1 * 8/2001 Shimomura et al. ..... 338/128
6,344,620 B1 * 2/2002 Nakamura ..... 200/6 A

* cited by examiner

*Primary Examiner*—Elvin Enad
*Assistant Examiner*—Lisa N Klaus
(74) *Attorney, Agent, or Firm*—Armstrong, Westerman & Hattori, LLP

(57) ABSTRACT

It is an object of the present invention to restrain the entire height of a multi-directional input apparatus called a joystick. As shown in FIG. 2, in order to operate a set of upper and lower turning members (40A) and (40B), convex operating portions (42A) and (42B) provided on axially intermediate portions of the turning members (40A) and (40B) are projected downward or upward. A hoisting and lowering slider (50) and a spring (60) for holding the turning members (40A) and (40B) at their neutral positions are disposed on the side where the operating portions (42A) and (42B) are projected such as to be located around the operating portions (42A) and (42B). In order to turnably support the operating member (30), a support portion (32) having a large diameter is provided on an axial portion of the operating member (30) on the opposite side from the side where the operating portions (42A) and (42B) are projected. Turning centers of the operating member (30) and the turning members (40A) and (40B) are located on an upper portion or lower portion in the case (10), and the hoisting and lowering slider (50) and the spring (60) are efficiently accommodated in the lower or upper space.

7 Claims, 14 Drawing Sheets

MULTI DIRECTIONAL INPUT APPARATUS

TECHNICAL FIELD

The present invention relates to a multi-directional input apparatus for inputting various signals by operating an operating member which is operated in arbitrary directions therearound.

BACKGROUND OF THE INVENTION

A multi-directional input apparatus of this type, called "a joystick," is usually supported in a case such that the apparatus can be turned in two directions perpendicular to each other, and comprises a set of upper and lower turning members having long holes each extending in a direction perpendicular to the turning direction, an operating member passing through the long holes of the set of upper turning members for turning the turning members by operating the operating member in an arbitrary circumferential direction, a spring compressed and accommodated in the case for automatically returning the operating member to its neutral position, and a set of signal output means for outputting a signal corresponding to the turning angle of each of the turning members.

In such a multi-directional input apparatus, it is necessary to pivotally support a lower portion of the operating member by the lower turning member such that the lower portion of the operating member can turn in a direction of the long hole. As a pivotally supporting mechanism of the operating member, in a multi-direction input apparatus described in each of Japanese Utility Model Publication Nos. H5-19925 and H7-27608 and Japanese Patent Application Laid-Open Publication No. H10-283885, for example, a lower portion of the operating member is connected to a lower turning member by means of a pin directed to a direction perpendicular to the long hole. With this structure, the operating member is turned in the direction of the long hole of the lower turning member, thereby turning the upper turning member. Further, the operating member is turned together with the lower turning member in the direction of the long hole of the upper turning member, thereby turning the lower turning member.

Further, in order to operate the turning member by the operating member, it is necessary to convert the including motion of the operating member into turning motion of the turning member. For this conversion, an arc convex operating portion is provided on an axially intermediate portion of the turning member through which the operating member passes.

As a structure for automatically returning the operating member to its neutral position, the multi-directional input apparatus disclosed in Japanese Utility Model Publication No. H5-19925 employs a structure in which the set of upper and lower turning members is resiliently held at the neutral position by a pushing member biased upward by a spring.

Further, as the automatic returning structure of the operating member, the multi-directional input apparatus disclosed in each of Japanese Utility Model Publication Nos. H7-27608 and H10-283885 employs a structure in which a pan-like operating body provided on a lower end of the operating member is resiliently pushed upward by a spring provided below the operating body.

However, these conventional multi-directional input apparatuses have the following problems relating to the pivotal support structure and the automatic returning structure for the operating member:

In any of there multi-directional input apparatuses, since an intermediate portion of the operating member is connected to the lower turning member by means of the pin, the entire length of the operating member is increased, and it is difficult to reduce the apparatus in size and height.

Concerning the returning mechanism for returning the operating member to the neutral position, according to the multi-directional input apparatus described in Japanese Utility Model Publication No. H7-27608 and Japanese Patent Application Laid-Open Publication No. H10-283885, the spring is disposed below the operating member in series, and a large space for accommodating the space is required below the spring. Therefore, it is difficult to reduce the size of the apparatus including the height thereof.

The present invention has been accomplished in view of these circumstances, and it is an object of the invention to provide a multi-directional input apparatus in which the apparatus can easily be reduced in size including its height.

SUMMARY OF THE INVENTION

To achieve the above object, a first multi-directional input apparatus of the present invention comprises a set of upper and lower turning members supported in the case such that the turning members can turn into two intersecting X and Y directions and each having a long hole extending in a direction perpendicular to the X and Y directions; an operating member passing through each of the long holes of the set of upper and lower turning members, the operating member turning each of the turning members when the operating member is operated in arbitrary directions therearound; a returning mechanism for automatically returning the operating member to its neutral position; and a set of signal output means connected to ends of the set of upper and lower turning members for outputting a signal corresponding to a turning angle of each of the turning members; wherein convex operating portions provided on axially intermediate portions of the set of upper and lower turning members are projected downward so as to operate the turning members, the returning mechanism is disposed below the turning member around the projecting operating portions, and the operating member is provided at its portion in its axial direction with a support portion having a large diameter located above the turning members so as to turnably support the operating member in the case.

According to the first multi-directional input apparatus of the present invention, the operating member is supported in the case by the support portion having a large diameter provided on an axial portion of the operating member without using a pin. Therefore, as compared with a case in which a pin is used, a length of the operating member is shortened, and it is easy to reduce the apparatus in height. Further, since the convex operating portion of each turning member is projected downward, and the support portion of the operating member is located thereon, the support portion is fitted in the operating portion, and an increased height caused by providing the operating portion is suppressed. At the same time, the turning center of the turning member is located at an upper portion together with the turning center of the operating member, and the lower space is enlarged. Further, since the returning mechanism is disposed in this space around the operating portion, the increase in height of the apparatus caused by disposing the returning mechanism can be suppressed to the minimum. Therefore, the height of the apparatus can largely be reduced.

To suppress the height of the apparatus, it is preferable that the support portion of the operating member is turnably disposed between a ceiling of the case and the operating portion of the upper turning member. In this case, the support portion of the operating member can be supported by sandwiching the support portion between the ceiling of the case and the operating portion of the upper turning member, or can be supported by connecting the support portion to the operating portion of the upper turning member so that the turning motion of the support portion is not hindered.

A second multi-directional input apparatus comprises a set of upper and lower turning members supported in the case such that the turning members can turn into two intersecting directions and each having a long hole extending in a direction perpendicular to the turning direction; an operating member passing through each of the long holes of the set of upper and lower turning members, the operating member turning each of the turning members when the operating member is operated in arbitrary directions therearound; a returning mechanism for automatically returning the operating member to its neutral position; and a set of signal output means connected to ends of the set of upper and lower turning members for outputting a signal corresponding to a turning angle of each of the turning members; wherein convex operating portions provided on an axially intermediate portion of the set of upper and lower turning members are projected upward so as to operate the turning members, the returning mechanism is disposed above the turning members around the projecting operating portions, and the operating member is provided at its portion in its axial direction with a support portion having a large diameter located below the turning member so as to turnably support the operating member in the case.

According to the a multi-directional input apparatus of the present invention, the operating member is supported in the case by the support portion having a large diameter provided on an axial portion of the operating member without using a pin. Therefore, as compared with a case in which a pin is used, a length of the operating member is shortened, and it is easy to reduce the apparatus in height. Further, since the convex operating portion of the turning member is projected upward, and the support portion of the operating member is located thereunder, the support portion is fitted in the operating portion, and an increased height caused by providing the operating portion is suppressed. At the same time, the turning center of the turning member is located at a possibly lowermost portion together with the turning center of the operating member, and the upper space is enlarged. Further, since the returning mechanism is disposed in this space around the operating portion, the increase in height of the apparatus caused by disposing the returning mechanism can be suppressed to the minimum. Therefore, the height of the apparatus can largely be reduced.

To suppress the height of the apparatus, it is preferable that the support portion of the operating member is turnably disposed between the operating portion of the lower turning member and a bottom plate of the case. In this case, the support portion of the operating member can be supported by sandwiching the support portion between the operating portion of the lower turning member and the bottom plate of the case. When the push-down switch (which will be described later) is provided below the operating member, the support portion can be supported by sandwiching the same between the operating portion of the lower turning member and the push-down switch.

It is preferable that the returning mechanism include a spring compressed and accommodated in the case, and an annular hoisting and lowering slider biased by the spring, the turning member is held at its neutral position by resiliently abutting the hoisting and lowering slider against a flat surface formed on opposite end shafts of the set of upper and lower turning members. With this structure, the returning mechanism is efficiently accommodated in the space around the operating portion.

In order to make it possible to operate a push-down switch disposed below the operating member, the operating member is capable of moving in its axial direction. In this case, the entire push-down switch can be mounted to the substrate that secures the case. Further, a snap plate constituting the push-down switch is mounted to a lower surface of the case. By mounting the snap plate to the lower surface of the case, the positional relation therebetween is stabilized, and the operating feeling of the switch is stabilized.

The set of signal output means may be any of electric sensors, optical sensors and magnetic sensors, and the kind thereof is not limited.

DESCRIPTION OF PREFERRED EMBODIMENTS OF THE INVENTION

Figure 1:
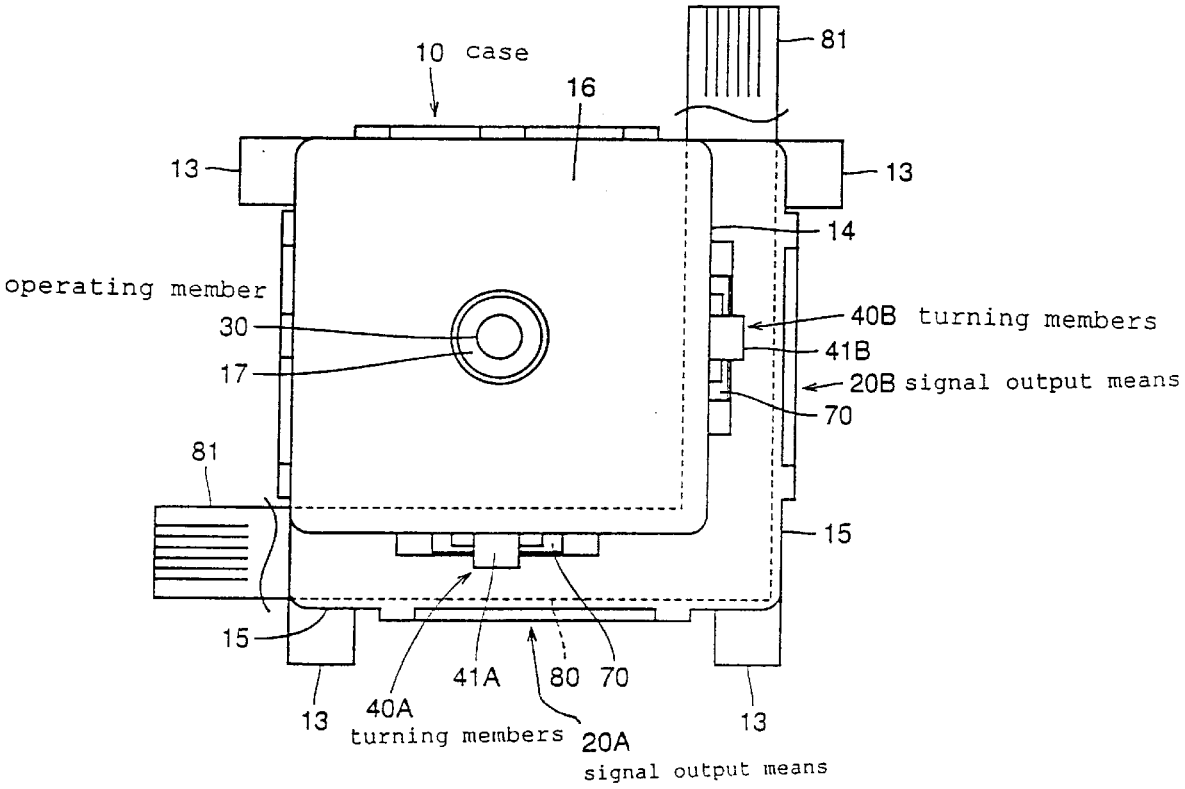
FIG. 1 is a plan view of a multi-directional input apparatus according to a first embodiment of the present invention.
Figure 2:
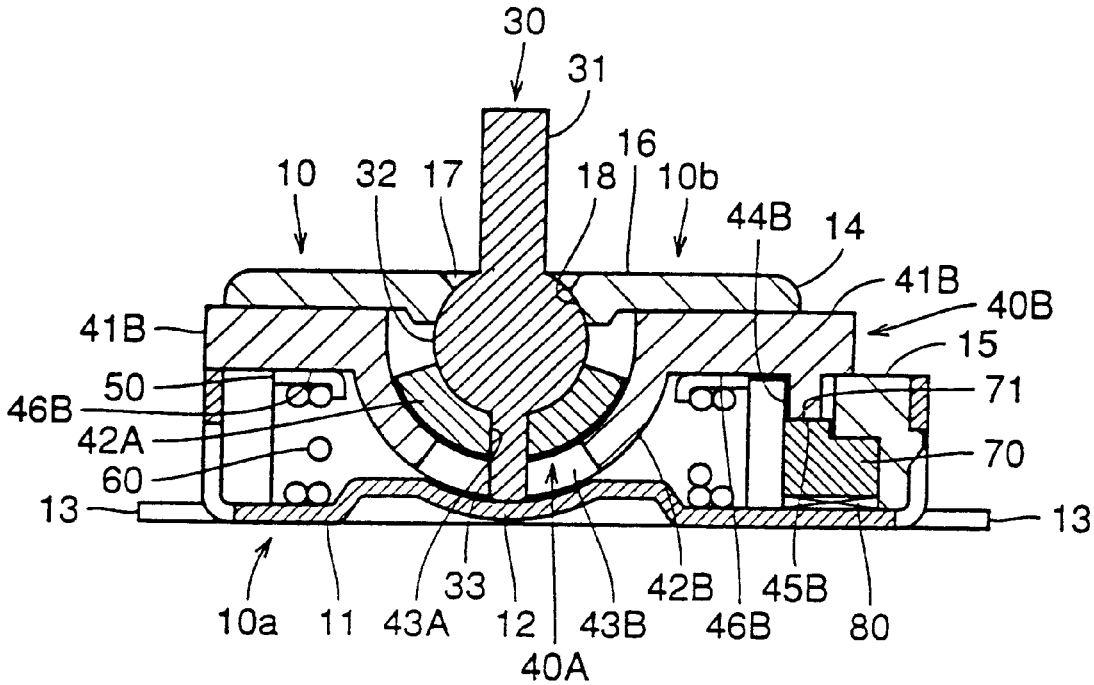
FIG. 2 is a vertical sectional front view of the multi-directional input apparatus.
Figure 3:
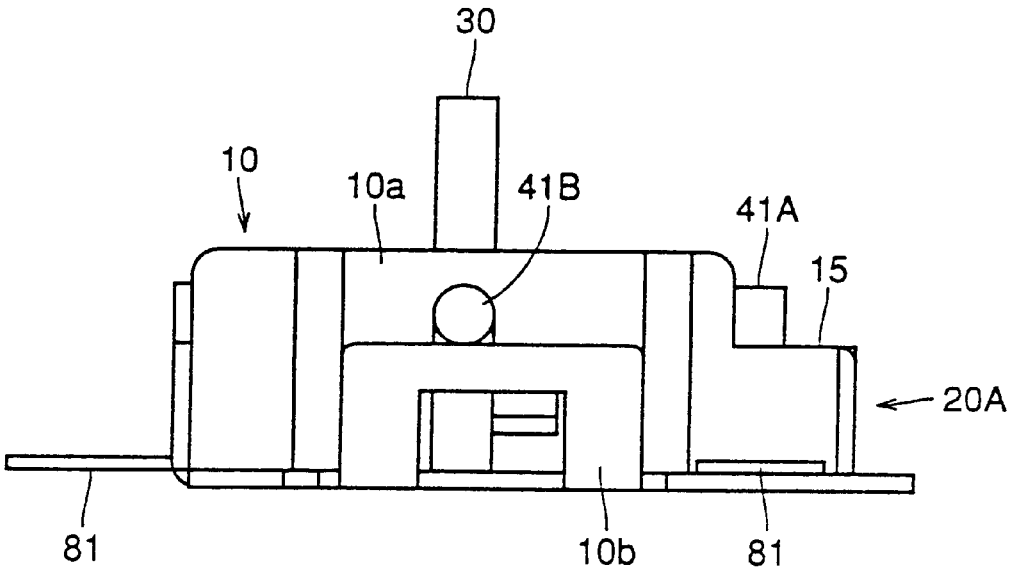
FIG. 3 is a left side view of the multi-directional input apparatus.
Figure 4:
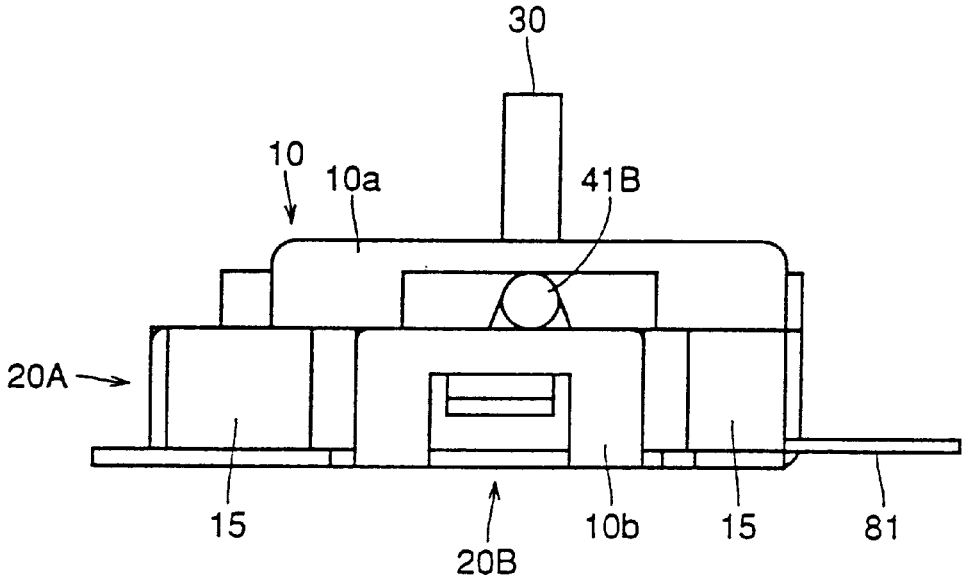
FIG. 4 is a right side view of the multi-directional input apparatus.
Figure 5:
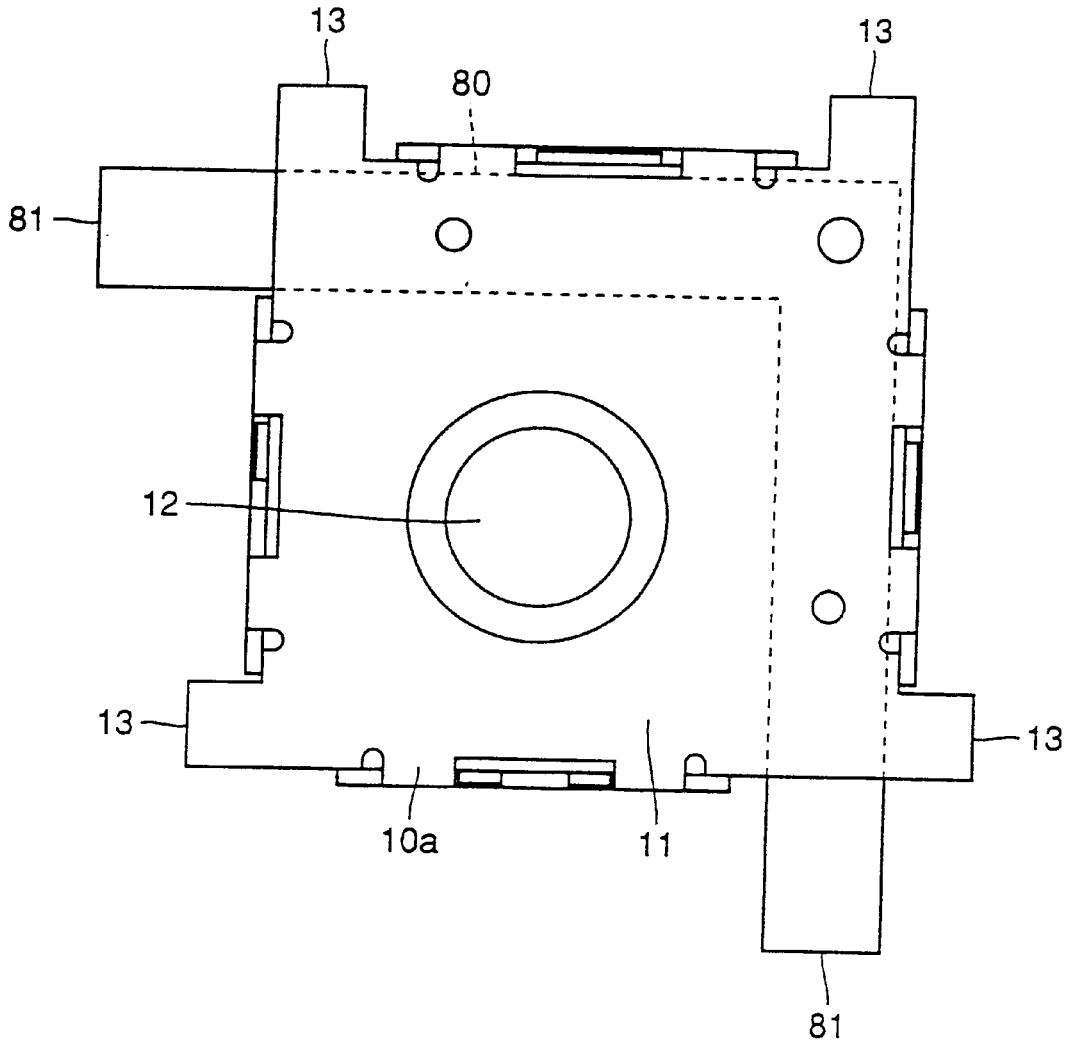
FIG. 5 is a bottom view of the multi-directional input apparatus.

Embodiments of the present invention will be explained based on the drawings below. As shown in FIGS. 1 to 5, a multi-directional input apparatus according to a first embodiment of the present invention comprises a box-like case 10 disposed on a mounting board, and a set of volume portions 20A and 20B as signal output means is integrally provided on two side surfaces of the case 10 intersecting at right angels.

The case 10 secured on the mounting board is of a two-piece structure comprising a combination of a lower case 10*a* formed into a box-shape made from metal plate and a resin upper case 10*b* fitted to the lower case 10*a* from above.

The metal lower case 10*a* includes a substantially rectangular bottom plate 11. The bottom plate 11 is provided at its central position with a downwardly projecting spherical concave portion 12 for supporting the lower turning member 40B. A plurality of projecting pieces 13 projecting sideways are formed on four corners of the bottom plate 11. The projecting pieces 13 are to be fixed to the mounting board.

The resin upper case 10*b* fitted to the lower case 10*a* includes a box-like body portion 14 whose lower surface is opened, and a pair of slider accommodating portions 15 and 15 integrally provided together with two side surfaces of the body portion 14 intersecting at right angles. The body portion 14 has a ceiling 16 provided with an opening 17 through which an upper portion of the operating member 30 is projected. The ceiling 16 is provided at its lower surface with an upwardly projecting spherical concave portion 18. The concave portion 18 is positioned around the opening 17. The pair of slider accommodating portions 15 and 15 are integrally formed into an L-shape along the two intersecting side surfaces of the body portion 14.

The operating member 30 includes a rod body 31 having a circular cross section, a spherical support portion 32 continuously formed on a lower portion of the rod body 31, and an operating portion 33 continuously formed on a lower portion of the support portion 32. The support portion 32 is turnably fitted to the concave portion 18 formed on a lower surface of the ceiling of the body portion 14 of the upper case 10*b*.

The upper turning member 40A is provided at its opposite ends with turning shafts 41A and 41A each having a circular cross section. The upper turning member 40A also includes a downwardly projecting arch operating portion 42A located between the turning shafts 41A and 41A. The operating portion 42A is provided with a long hole 43A extending toward a turning center axis as a guide hole for the operating member 30. An inner surface, i.e., an upper surface of the operating portion 42A is formed as a downwardly projecting spherical concave surface into which the spherical support portion 32 of the operating member 30 is fitted. An outer surface, i.e., a lower surface of the operating portion 42 is formed as a downwardly projecting spherical convex surface.

In order to connect the turning member 40A with the corresponding volume portion 20A, one of the turning shafts 41A and 41A is integrally formed at its tip end surface with a gear 44A. The gear 44A projects from a side of the body portion 14 of the upper case 10*a*, and is located above the slider accommodating portion 15. Here, the gear 44A is a fan-like member having an arc surface directed downward, and the arc surface is formed with spur gear teeth 45A.

The turning shafts 41A and 41A are connected to the arc portion 42A through shafts. Lower surfaces of the shafts are flat surfaces 46A and 46A against which a hoisting and lowering slider 50 resiliently abuts from below.

The lower turning member 40B is assembled below the upper turning member 40A at right angles. The turning member 40B is provided at its opposite ends with turning shafts 41B and 41B each having a circular cross section. The turning member 40B also includes a downwardly projecting arch operating portion 42B located between the turning shafts 41B and 41B. The operating portion 42B is provided with a long hole 43B extended toward the turning center axis as a guide hole for the operating member 30. An inner surface, i.e., upper surface of the operating portion 42B is formed as a downwardly projecting spherical concave surface into which the operating portion 42A of the turning member 40A is fitted. An outer surface, i.e., a lower surface of the operating portion 43B is formed as a downwardly projecting spherical convex surface corresponding to the downwardly projecting spherical concave portion 12 provided on the bottom plate 11 of the case 10.

In order to connect the turning member 40B with the corresponding volume portion 20B, one of the turning shafts 41B and 41B is integrally formed at its tip end surface with a gear 44B. The gear 44B projects from a side of the body portion 14 of the upper case 10*a*, and is located above the slider accommodating portion 15. Here, the gear 44B is a fan-like member having an arc surface directed downward, and the arc surface is formed with spur gear teeth 45B.

The turning shafts 41B and 41B are connected to the arc portion 42B through shafts. Lower surfaces of the shafts are flat surfaces 46B and 46B against which a hoisting and lowering slider 50 resiliently abuts from below. The flat surfaces 46B and 46B are flush with the flat surfaces 46A and 46A of the upper turning member 40A.

The set of upper and lower turning members 40A and 40B are assembled into the case 10 in a state in which turning center axes thereof intersect at right angles on the same plane, and are turnably supported in the case 10. The support portion 32 is supported between the ceiling 16 of the case 10 and the operating portion 42A of the upper turning member 40A, so that the operating member 30 is turnably supported in the case 10. The operating portion 33 of the operating member 30 is inserted into the long holes 43A and 43B of the turning members 40A and 40B. With this design, the operating member 30 can incline in all peripheral directions around the support portion 32, and this inclining motion turns the turning member 40A and 40B.

The hoisting and lowering slider 50 for automatically returning the operating member 30 to its neutral position is disposed such as to surround the operating portions 42A and 42B of the turning members 40A and 40B below the turning members 40A and 40B. The hoisting and lowering slider 50 is an annular body having a substantially rectangular outer peripheral surface fitted into the case 10 such that the hoisting and lowering slider 50 can be hoisted and lowered. The hoisting and lowering slider 50 is biased upward by a spring 60 compressed and accommodated between the hoisting and lowering slider 50 and the bottom plate 11 of the case 10. By this biasing operation, the hoisting and lowering slider 50 is brought into resilient surface-contact with the flat surfaces 46A and 46A of the turning member 40A and the flat surfaces 46B and 46B of the turning member 40B, thereby resiliently holding the turning members 40A and 40B at their neutral positions to resiliently hold the operating member 30 at its neutral position.

The straight-ahead sliders 70 and 70 are accommodated in the slider accommodating portions 15 and 15 of the case 10, and an L-shaped flexible substrate 80 is also accommodated astride the slider accommodating portions 15 and 15. The straight-ahead sliders 70 and 70 can move in the horizontal direction along the two right-angled side surfaces of the body 14 of the case 10. Each of the straight-ahead sliders 70 is formed at its upper surface with rack gear teeth 71, and downwardly directed fan-like gears 44A and 44B formed on portions of the turning members 40A and 40B are meshed with the teeth 71.

The L-shaped flexible substrate 80 is disposed below the straight-ahead sliders 70 and 70 in the slider accommodating portions 15 and 15. The flexible substrate 80 is formed at its upper surface with a pair of resistant circuits corresponding to the straight-ahead sliders 70 and 70 by printing. Contacts mounted to lower surfaces of the straight-ahead sliders 70 and 70 are brought into contact with the pair of resistant circuits to constitute volumes. Opposite ends of the flexible substrate 80 project outward of the slider accommodating portions 15 and 15 as connecting portions 81 and 81 to be connected to a mounting substrate.

Next, a function of the multi-directional input apparatus according to the first embodiment of the present invention will be explained.

If the operating member 30 is inclined in the direction of the long hole 43B of the lower turning member 40B, the upper turning member 40A is turned and the volume portion 20A is operated, and a signal corresponding to the operated amount is output. That is, in the volume portion 20A, as the gear 44A is turned by the turning motion of the turning member 40A, the straight-ahead slider 70 moves, its contact slides on the corresponding resistant circuit on the flexible substrate 80, and a resistant value corresponding to the operated amount can be obtained.

If the operating member 30 is inclined in the direction of the long hole 43A of the upper turning member 40A, the lower turning member 40B is turned and the volume portion 20B is operated, and a signal corresponding to the operated amount is output. That is, in the volume portion 20B, as the gear 44B is turned by the turning motion of the turning member 40B, the straight-ahead slider 70 moves, its contact slides on the corresponding resistant circuit on the flexible substrate 80, and a resistant value corresponding to the operated amount can be obtained.

With a combination of them, the operating member 30 is operated in an arbitrary direction therearound, a signal corresponding to the operated direction and the operated amount is input to the electron equipment using the multi-directional input apparatus.

Here, the operating member 30 is supported in the case 10 by the spherical operating portion 32 provided on a portion of the operating member 30 in its axial direction without using a pin. Therefore, as compared with a case in which a pin is used, a length of the operating member 30 is shortened, and it is easy to reduce the apparatus in height.

Further, the spherical operating portion 32 is supported between the ceiling 16 of the case 10 and the operating portions 42A and 42B of the downwardly projecting turning members 40A and 40B, the upper portion of the operating portion 32 is fitted into the concave portion 18 provided in the lower surface of the ceiling 16, and the lower half of the operating portion 32 is accommodated in the operating portions 42A and 42B of the turning members 40A and 40B. With this operation, the center of the turning motion of the operating member 30 is located at possibly the uppermost position in the case 10, and the lower space of both the shafts of the turning members 40A and 40B is enlarged. The hoisting and lowering slider 50 and the spring 60 are disposed around the operating portions 42A and 42B of the turning members 40A and 40B in the enlarged lower space. Therefore, an increase in height of the apparatus caused by disposing the hoisting and lowering slider 50 and the spring 60 can be suppressed.

Of the lower case 10*a* and the upper case 10*b* constituting the case 10, the lower case 10*a* from which the operating portions 42A and 42B of the turning members 40A and 40B project is made of thin metal plate.

Therefore, in the multi-directional input apparatus of the first embodiment of the present invention, the height of the apparatus can largely be reduced.

Further, since the volume portions 20A and 20B as the signal output means are integrally formed in the apparatus, the number of parts is small, and the cost is low as compared with an apparatus using external volumes.

Figure 6:
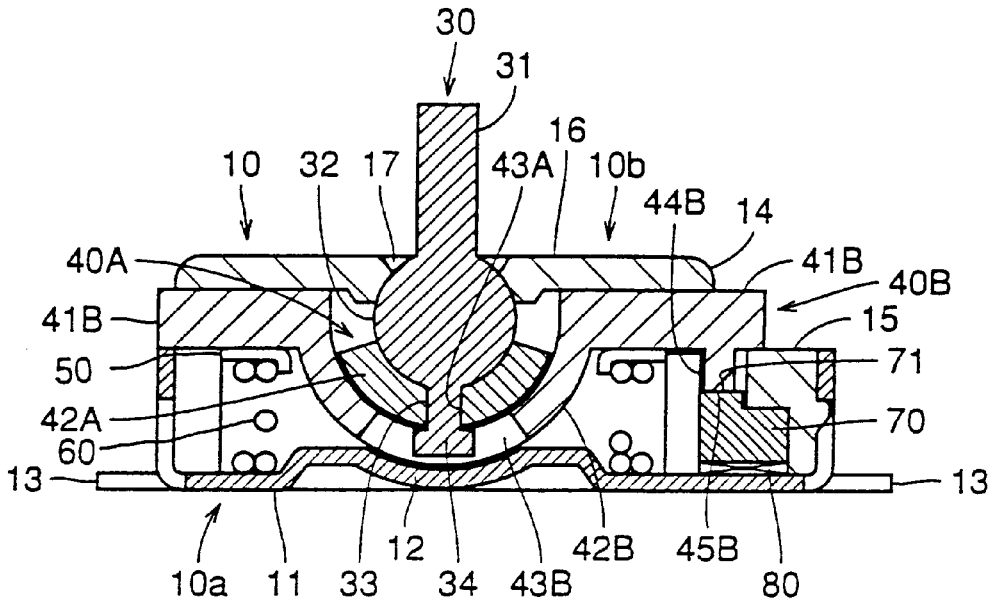
FIG. 6 is a vertical sectional front view of the multi-directional input apparatus according to a second embodiment of the present invention.
Figure 7:
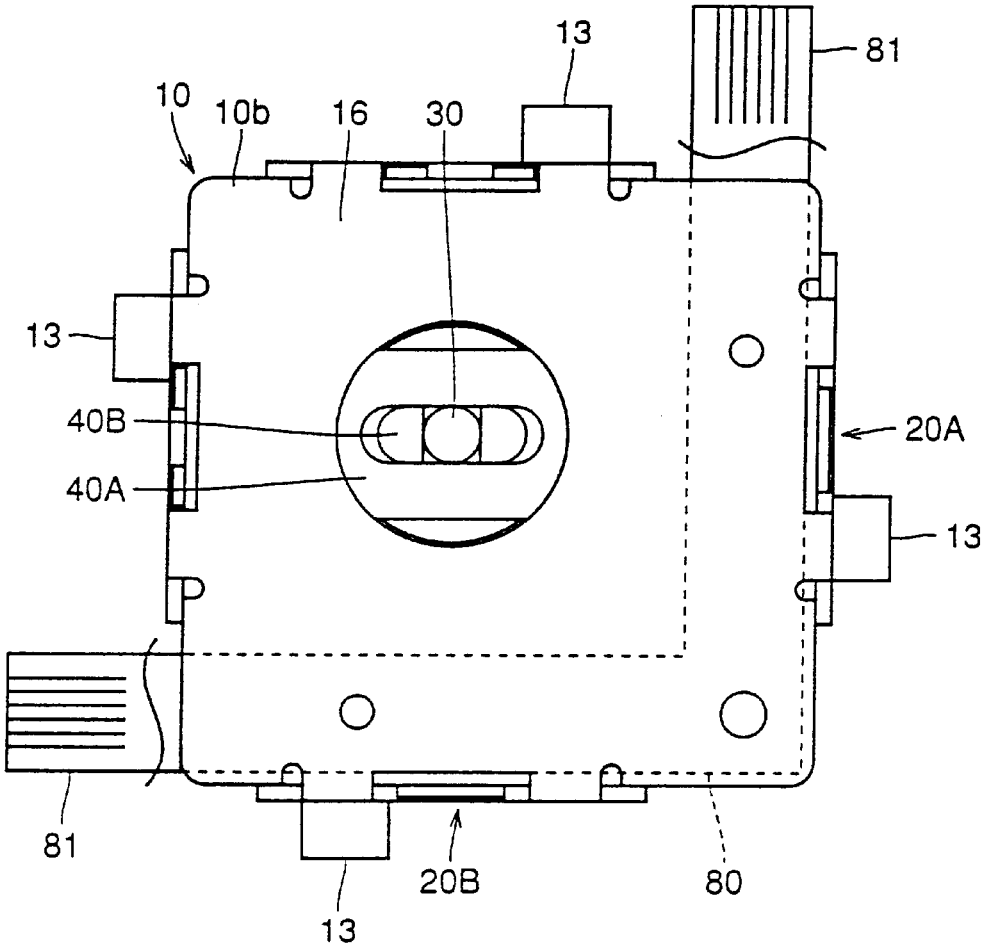
FIG. 7 is a plan view of the multi-directional input apparatus according to a third embodiment of the present invention.
Figure 8:
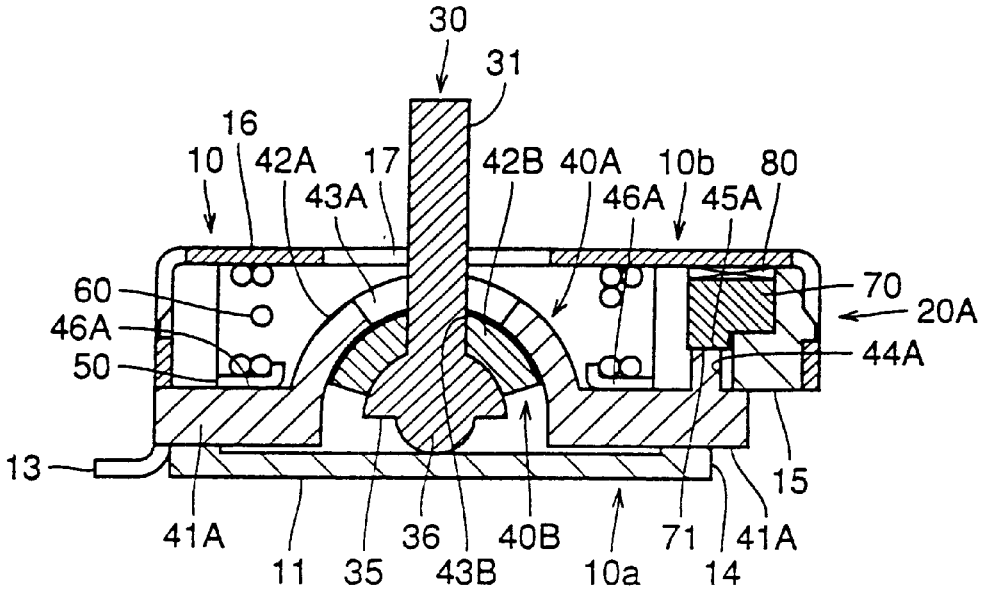
FIG. 8 is a vertical front view of the multi-directional input apparatus.
Figure 9:
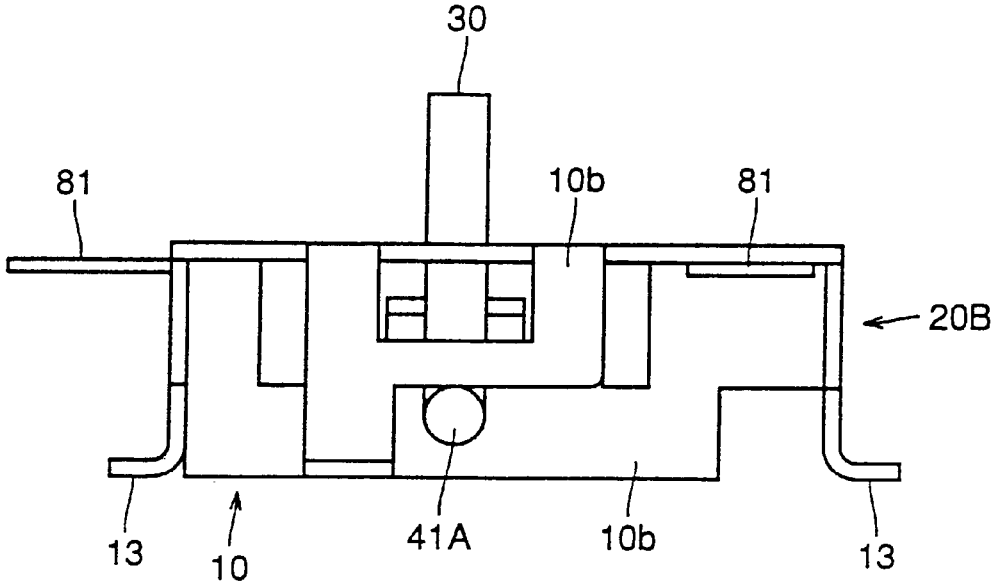
FIG. 9 is a left side view of the multi-directional input apparatus.
Figure 10:
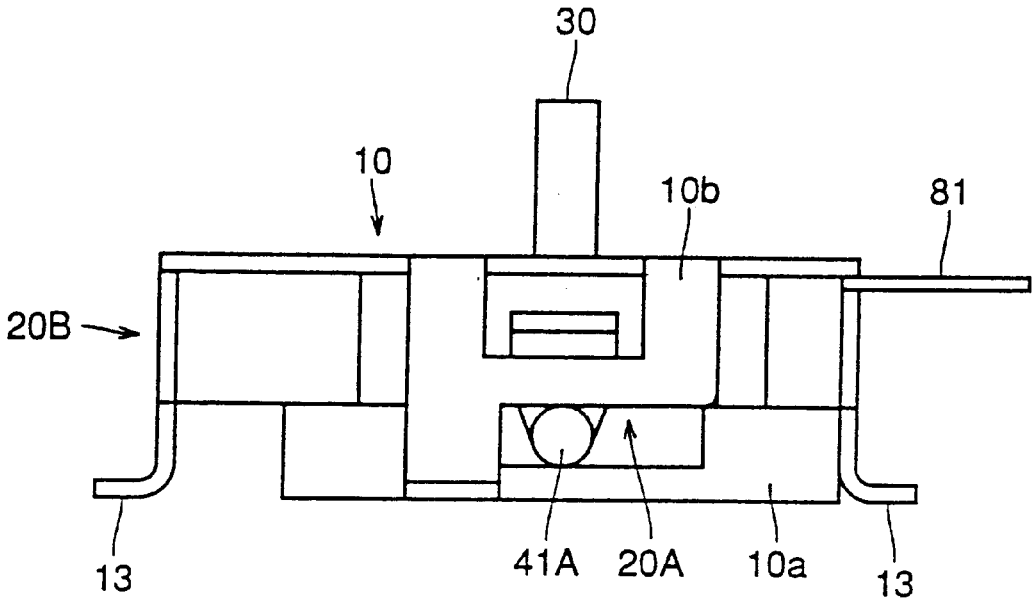
FIG. 10 is a right side view of the multi-directional input apparatus.
Figure 11:
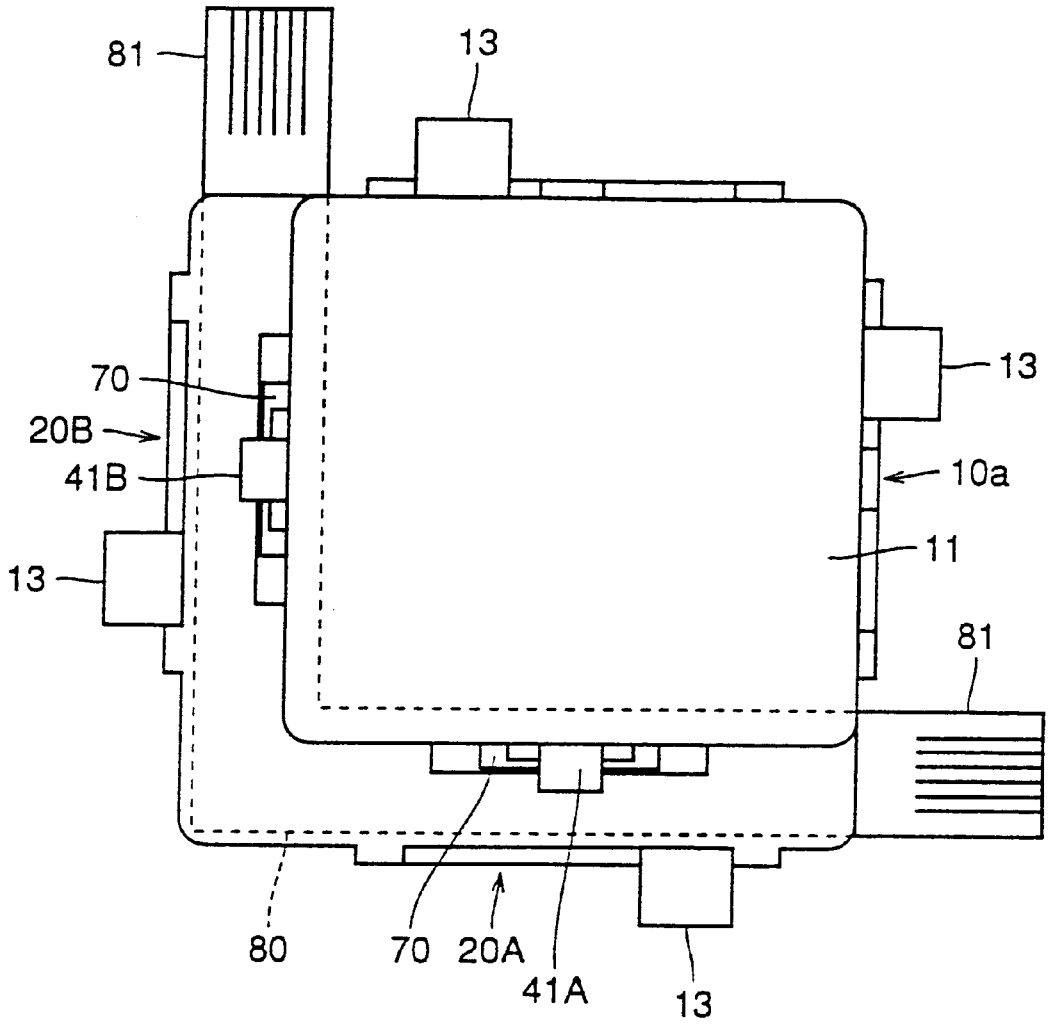
FIG. 11 is a bottom view of the multi-directional input apparatus.

Next, a multi-directional input apparatus according to a second embodiment of the present invention will be explained with reference to FIG. 6. The multi-directional input apparatus of the second embodiment of the present invention is different from that of the first embodiment shown in FIGS. 1 to 5 in the support structure for the operating member 30. That is, in the multi-directional input apparatus of the first embodiment, the support portion 32 of the operating member 30 is sandwiched between the ceiling 16 of the case 10 and the operating portion 42A of the upper turning member 40, and the support portion 32 is prevented from falling out by the ceiling 16 of the case 10. In the multi-directional input apparatus of the second embodiment, and an engaging portion 34 provided on a lower end of the operating member 30 engages the operating portion 42A of the upper turning member 40, the support portion 32 of the operating member 30 is turnably connected to the operating portion 42A of the upper turning member 40 so that the operating member 30 is prevented from falling out and from rotating around the axis.

As described above, in the multidirectional input apparatus of the present invention, the support structure for the operating member 30 is not particularly limited.

Next, a multi-directional input apparatus according to a third embodiment of the present invention will be explained with reference to FIGS. 7 to 11.

The multi-directional input apparatus of the third embodiment of the invention is different from the multi-directional input apparatus of the first embodiment of the invention mainly in that the operating portions 42A and 42B of the turning members 40A and 40B project upward, and space for accommodating the hoisting and lowering slider 50 and the spring 60 is secured above the operating portions 42A and 42B, and in that, in association with the above structure, the flexible substrate 80 is disposed above the straight-ahead slider 70.

That is, in the multi-directional input apparatus of the third embodiment of the invention, the case 10 comprises a resin lower case 10*a* forming a bottom plate, and a metal upper case 10*b* to be put on the lower case 10*a* from above. The slider accommodating portions 15 and 15 for accommodating the straight-ahead sliders 70 and 70 are integrally and continuously provided on the side of the resin lower case 10*a*.

The turning members 40A and 40B include upwardly projecting arch operating portions 42A and 42B between opposite end turning shafts. The hoisting and lowering slider 50 is disposed above the opposite end shafts of the turning members 40A and 40B, and is biased downward by the spring 60 compressed and accommodated between the ceiling 16 of the case 10 and the hoisting and lowering slider 50. By this biasing operation, the hoisting and lowering slider 50 is brought into resilient surface-contact with the flat surfaces 46A and 46A formed on the upper surface of the opposite end shafts of the turning members 40A and 40B, thereby holding the operating member 30 and the turning members 40A and 40B at their neutral positions.

The operating member 30 includes an upwardly projecting semi-spherical first support portion 35 above a shaft 31, and a downwardly projecting semi-spherical second support portion 36 below the shaft 31. The first support portion 35 is fitted into the operating portion 42B of the lower turning member 40B from below, and also functions as a falling-out preventing portion for the operating member 30. The second support portion 36 is supported on the bottom plate 11 of the case 10.

The straight-ahead slider 70 is accommodated in the slider accommodating portion 15 of the case 10, and the flexible substrate 80 is located above the straight-ahead slider 70 and accommodated in the slider accommodating portion 15. The straight-ahead slider 70 is provided at its lower surface with rack gear teeth 71. Fan-like gears 44A and 44B are formed on portions of the corresponding turning members 40A and 40B such that the gears 44A and 44B are directed upward. The gears 44A and 44B are meshed with the teeth 71. A contact is mounted to an upper surface of the straight-ahead slider 70. The contact is in resilient contact with a resistant circuit formed on a lower surface of the flexible substrate 80.

Other structure is substantially the same as that of the multi-directional input apparatus of the first embodiment of the invention, the same elements are designated with the same symbols, and detailed explanation is omitted.

In the multi-directional input apparatus of the third embodiment shown in FIGS. 7 to 11, like the multi-directional input apparatus of the first embodiment, the operating member 30 is operated in an arbitrary direction therearound, a signal corresponding to the operated direction and the operated amount is input to the electron equipment using the multi-directional input apparatus.

Here, the operating member 30 is supported in the case 10 by the semi-spherical first support portion 35 and the second support portion 36 provided on a portion of the operating member 30 in its axial direction without using a pin. Therefore, as compared with a case in which a pin is used, a length of the operating member 30 is shortened, and it is easy to reduce the apparatus in height.

Further, the first support portion 35 and the second support portion 36 are supported between the bottom plate 11 of the case 10 and the operating portion 42B of the upwardly projecting turning member 40B, and most of portions of the first support portion 35 and the second support portion 36 are accommodated in the operating portion 42B of the turning member 40B. With this design, the turning center of the operating member 30 is located at a possibly lower most position within the case 10 together with the turning centers of the turning members 40A and 40B, and the upper space of the opposite end shafts of the turning members 40A and 40B is enlarged. The hoisting and lowering slider 50 and the spring 60 are disposed in the enlarged upper space around the operating portions 42A and 42B of the turning members 40A and 40B. Therefore, an increase in height of the apparatus caused by disposing the hoisting and lowering slider 50 and the spring 60 can be suppressed.

Further, of the lower case 10*a* and the upper case 10*b* constituting the case 10, the upper case 10*b* from which the operating portions 42A and 42B of the turning members 40A and 40B project is made of thin metal plate.

Therefore, in the multi-directional input apparatus of the third embodiment of the present invention, like the multi-directional input apparatus of the first embodiment, the height of the apparatus can largely be reduced.

Further, since the volume portions 20A and 20B as the signal output means are integrally formed in the apparatus, the number of parts is small, and the cost is low as compared with an apparatus using external volumes.

Next, a fourth embodiment of the present invention will be explained with reference to FIGS. 12 to 14. A multi-directional input apparatus according to the fourth embodiment of the present invention is different from that of the third embodiment of the invention mainly in that a lower pushing-down switch is operated by the operating member 30 and in that the flexible substrate 80 is disposed below the straight-ahead slider 70 in the volume portions 20A and 20B.

That is, in the multi-directional input apparatus of the fourth embodiment of the present invention, in order to make it possible to move the operating member 30 in the axial direction, the bottom plate 11 of the case 10 is provided with an opening 19 below the operating member 30. Further, a snap plate 90 is mounted to a lower surface of the bottom plate 11 to bias the operating member 30 upward. The snap plate 90 includes a frame-like support portion 91 secured to a lower surface of the bottom plate 11, and a circular operating portion 92 provided inside the support portion 91 and supported by radial arms. The snap plate 90 is accommodated in a shallow concave portion provided in the lower surface. If the second support portion 36 of the operating member 30 is resiliently pushed upward through the opening 19 provided in the bottom plate 11, the push-down switch is constituted together with a contact formed on a surface of a mounting substrate.

Opposite sides of the first support portion 35 of the operating member 30 are removed so as to prevent the operating member 30 from rotating around its axis.

The straight-ahead sliders 70 and 70 are accommodated in the slider accommodating portions 15 and 15 of the case 10, and the flexible substrates 80 and 80 are located in the slider accommodating portions 15 and 15 below the straight-ahead sliders 70 and 70. The straight-ahead sliders 70 and 70 are provided at their inner side surfaces with concave portions 72 and 72 into which the gears 44A and 44B of the turning members 40A and 40B are inserted. The concave portions 72 and 72 are opened downward, and ceiling surfaces of the concave portions 72 and 72 are provided with rack gear teeth 71 with which the upwardly directing gears 44A and 44B mesh. On the other hand, a contact 73 is mounted to a lower surface of each the straight-ahead slider 70, and the contact 73 comes into contact with a resistant circuit formed on an upper surface of the lower flexible substrate 80 from above.

Other structure is substantially the same as that of the multi-directional input apparatus of the third embodiment of the invention so that the same elements are designated with the same symbols, and a detailed explanation is omitted.

Figure 12:
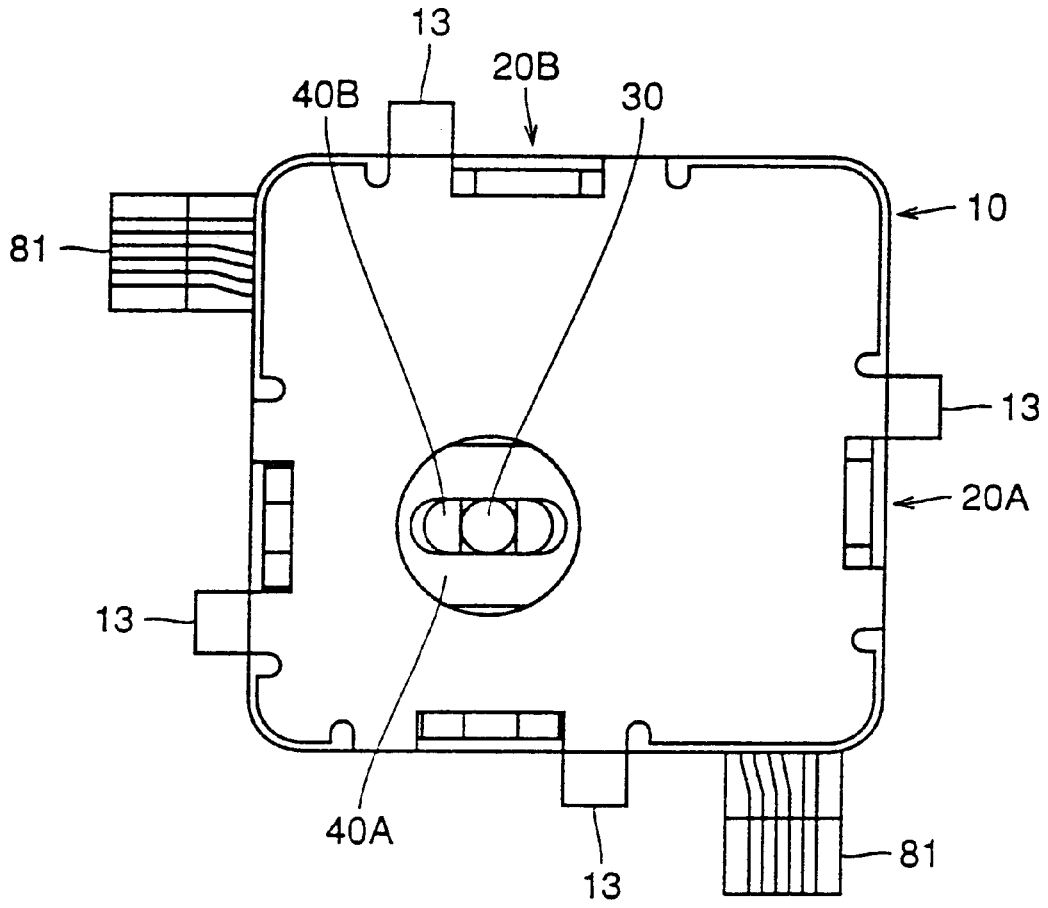
FIG. 12 is a plan view of the multi-directional input apparatus according to a fourth embodiment of the present invention.
Figure 13:
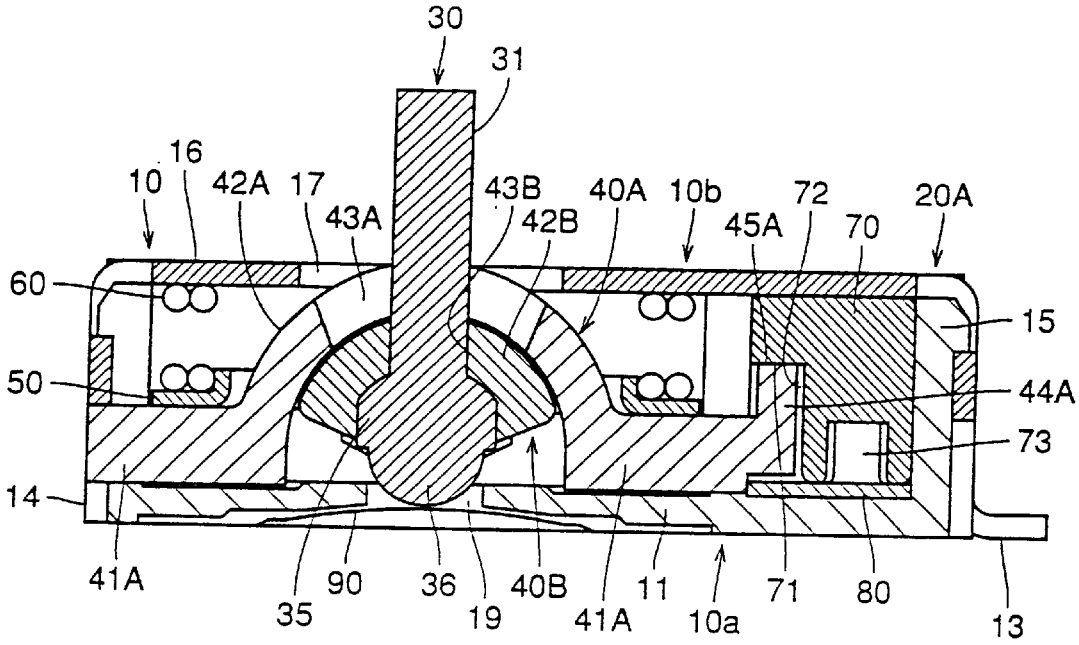
FIG. 13 is a vertical front view of the multi-directional input apparatus.
Figure 14:
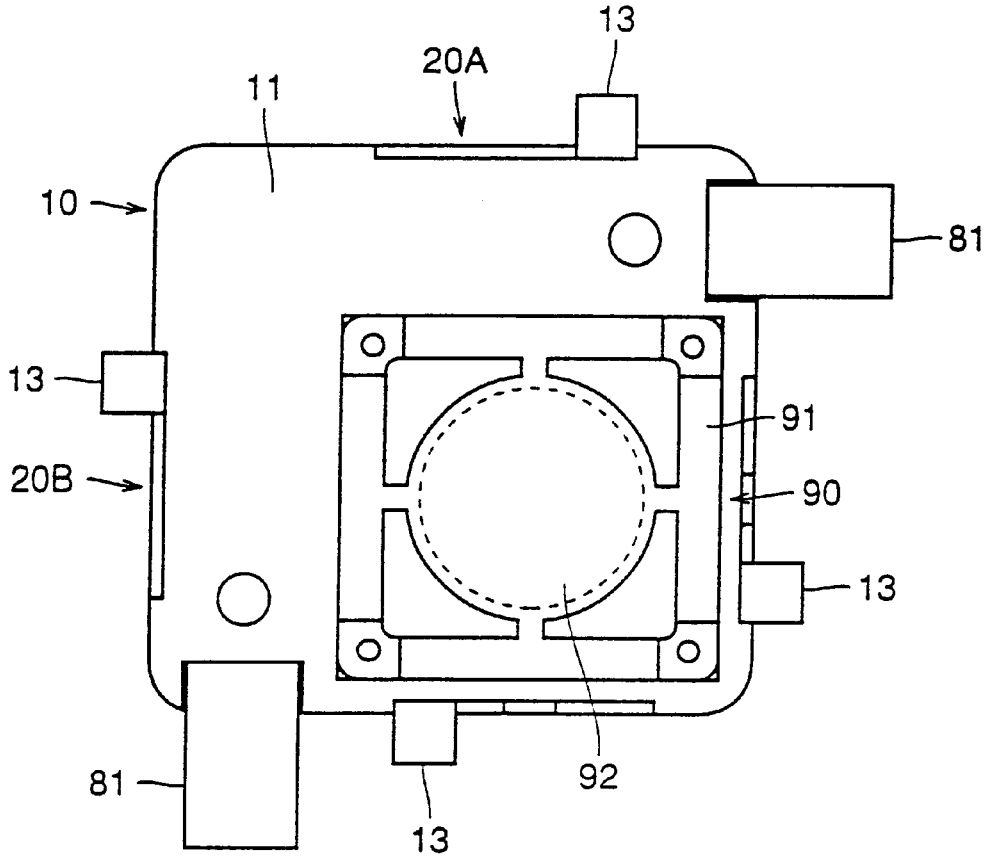
FIG. 14 is a bottom view of the multi-directional input apparatus.

In the multi-directional input apparatus of the fourth embodiment shown in FIGS. 12 to 14, the operating member 30 is pushed down in the axial direction against the biasing force of the snap plate 90, thereby deforming the snap plate 90 downward. By the deformed portion, the contact formed on the surface of the mounting substrate is short-circuited. With this design, a function of the push-down switch can be obtained. Further, since the flexible substrates 80 and 80 are disposed below the straight-ahead sliders 70 and 70, and the gears 44 and 44 are meshed with the straight-ahead sliders 70 and 70 from below, the height of each of the volume portions 20A and 20B is suppressed. This structure is effective especially for a case 10 whose height is limited.

As described above, in the multi-directional input apparatus of the present invention, the push-down switch is combined if necessary. When the push-down switch is combined also, the width of the apparatus can be largely reduced.

As compared with a structure in which the snap plate 90 is mounted on the side of the mounting substrate, in this multi-directional input apparatus of the fourth embodiment, since the snap plate 90 is mounted on the side of the multi-directional input apparatus, an operating feeling of the push-down switch is stabilized.

That is, when the snap plate 90 is mounted on the side of the mounting substrate, a positional precision between the operating member 30 and the snap plate 90 is lowered, and a feeling when the operating member 30 is pushed down is not stable. However, if the snap plate 90 is mounted on the side of the multi-directional input apparatus as in the fourth embodiment, this feeling is stabilized.

In addition to this, in the multi-directional input apparatus of the fourth embodiment, although the gears 44A and 44B of the turning members 40A and 40B mesh the teeth 71 and 72 of the straight-ahead sliders 70 and 70 from below, since the flexible substrates 80 and 80 are disposed below the straight-ahead sliders 70 and 70 and each flexible substrate 80 approaches the mounting substrate, connecting operation therebetween becomes easy.

As can be found from the above fact, in the flexible substrate 80, irrespective of whether the operating portions 42A and 42B of the turning members 40A and 40B project upward or downward, it is preferable that the operating portions 42A and 42B are disposed below the straight-ahead sliders 70 and 70 in terms of connection with the mounting substrate.

Although the signal outputting means is integrally formed with the multi-directional input apparatus as the volume portions 20A and 20B in each of the embodiments, the signal outputting means may be an external volume, or an optical sensor or a magnetic sensor other than the volume, and such kind of the means is not limited.

As explained above, in the first multi-directional input apparatus of the present invention, convex operating portions provided on axially intermediate portions of the set of upper and lower turning members are projected downward so as to operate the turning members, the returning mechanism is disposed below the turning member around the projecting operating portions, and the operating member is provided at its portion in its axial direction with a support portion having a large diameter located above the turning member so as to turnably support the operating member in the case. With this structure, space for accommodating the returning mechanism can effectively be secured in the case, and the height of the apparatus can largely be suppressed.

In the second multi-directional input apparatus of the invention, convex operating portions provided on axially intermediate portions of the set of upper and lower turning members are projected upward so as to operate the turning members, the returning mechanism is disposed above the turning members around the projecting operating portions, and the operating member is provided at its portion in its axial direction with a support portion having a large diameter located below the turning member so as to turnably support the operating member in the case. With this structure, space for accommodating the returning mechanism can effectively be secured in the case, and the height of the apparatus can largely be suppressed.

If the support portion of the operating member is turnably disposed between a ceiling of the case and the operating portion of the upper turning member, the height of the apparatus can effectively be suppressed.

If the support portion of the operating member is turnably disposed between the operating portion of the lower turning member and a bottom plate of the case, the height of the apparatus can effectively be suppressed.

In order to make it possible to operate a push-down switch disposed below the operating member, the operating member is capable of moving in its axial direction and a snap plate constituting the push-down switch is mounted to a lower surface of the case. With this structure, the operating feeling when the push-down switch is also used can be stabilized.

What is claimed is:

1. A multi-directional input apparatus comprising a set of upper and lower turning members supported in a case such that said turning members can turn in intersecting x and y directions and each having a long hole extending in said y and x directions, respectively; an operating member passing through each of said long holes of said set of upper and lower turning members, said operating member turning each of said turning members when said operating member is operated in an arbitrary direction therearound; a returning mechanism for automatically returning said operating member to its neutral position; and a set of signal output means connected to ends of said set of upper and lower turning members for outputting signals corresponding to a turning angle of each of said turning members; wherein convex operating portions provided on an axially intermediate portion of said set of upper and lower turning members are projected downward so as to operate the turning members, said returning mechanism is disposed below said turning members around the projected convex operating portions, and said operating member is provided at its portion in its axial direction with a support portion having a large diameter located above said turning members so as to turnably support said operating member in said case.

2. A multi-directional input apparatus according to claim 1, wherein said support portion of said operating member is turnably disposed between a ceiling of said case and said operating portion of the upper turning member.

3. A multi-directional input apparatus comprising a set of upper and lower turning members supported in a case such that said turning members can turn in intersecting x and y directions and each having a long hole extending in said y and x directions, respectively; an operating member passing through each of said long holes of said set of upper and lower turning members, said operating member turning each of said turning members when said operating member is operated in an arbitrary direction therearound; a returning mechanism for automatically returning said operating member to its neutral position; and a set of signal output means connected to ends of said set of upper and lower turning members for outputting signals corresponding to a turning angle of each of said turning members; wherein convex operating portions provided on an axially intermediate portion of said set of upper and lower turning members are projected upward so as to operate the turning members, said returning mechanism is disposed above said turning members around the projected convex operating portions, and said operating member is provided at its portion in its axial direction with a support portion having a large diameter located below said turning members so as to turnably support said operating member in said case.

4. A multi-directional input apparatus according to claim 3, wherein said support portion of said operating member is turnably disposed between said operating portion of said lower turning member and a bottom plate of said case.

5. A multi-directional input apparatus according to claim 1, wherein said returning mechanism includes a spring compressed and accommodated in said case, and an annular hoisting and lowering slider biased by said spring, each said turning member is held at its neutral position by resiliently abutting said hoisting and lowering slider against a flat surface formed on opposite end shafts of said set of upper and lower turning members.

6. A multi-directional input apparatus according to claim 3, wherein, in order to make it possible to operate a push-down switch disposed below said operating member, said operating member is capable of moving in its axial direction and a snap plate constituting said push-down switch is mounted to a lower surface of said case.

7. A multi-directional input apparatus according to claim 1, wherein said set of signal output means are any of electrical sensors, optical sensors and magnetic sensors.

* * * * *